United States Patent [19]

Oida

[11] Patent Number: 4,613,794

[45] Date of Patent: Sep. 23, 1986

[54] CHARGE TRANSFER PLASMA DISPLAY DEVICE

[75] Inventor: Osamu Oida, Tokyo, Japan

[73] Assignee: NEC Corporation, Tokyo, Japan

[21] Appl. No.: 555,088

[22] Filed: Nov. 25, 1983

[30] Foreign Application Priority Data

Nov. 25, 1982 [JP] Japan ..... 57-206743
Jun. 23, 1983 [JP] Japan ..... 58-113151

[51] Int. Cl.[4] ..... G09G 3/10

[52] U.S. Cl. ..... 315/169.4; 315/169.2; 313/582; 313/583; 340/781

[58] Field of Search ..... 315/169.2, 169.4; 313/582, 583; 340/781

[56] References Cited

U.S. PATENT DOCUMENTS

| | | | |
|---|---|---|---|
| 2,925,530 | 2/1960 | Engelbart | 315/169.2 |
| 3,781,600 | 12/1973 | Coleman et al. | 313/582 |
| 3,898,515 | 8/1975 | Andoh et al. | 315/169.2 |
| 4,185,229 | 1/1980 | Yoshikawa et al. | 315/169.4 |
| 4,185,230 | 1/1980 | Walters | 315/169.4 |

*Primary Examiner*—Saxfield Chatmon

*Attorney, Agent, or Firm*—Burns, Doane, Swecker and Mathis

[57] ABSTRACT

A charge transfer plasma display device includes plural transfer electrodes arranged in an alternating fashion on opposite walls of a plasma-filled enclosure, so that the electrodes on one wall are interlaced between those on the other wall. Plural groups of write electrodes are disposed at one end of the transfer electrode arrangement, with each write electrode in each group being connected in parallel with an associated write electrode in every other group. Disposed between the write electrodes and the transfer electrodes are plural input shift electrodes. The input shift electrodes have different lengths so that a different number of such electrodes are disposed between each group of write electrodes and the transfer electrodes. In operation, the input shift and transfer electrodes are successively energized in a continuing sequence, and the write electrodes are selectively energized, in coordination with the energization of the shift electrodes, to create "pips" of light. Alternatively, the write electrodes can be successively energized and the shift electrodes selectively energized in coordination therewith.

8 Claims, 6 Drawing Figures

CHARGE TRANSFER PLASMA DISPLAY DEVICE

BACKGROUND OF THE INVENTION

The present invention relates to a plasma display device, and more particulary, to a charge transfer plasma display device.

A gaseous discharge device is described in U.S. Pat. No. 3,781,600 by William E. Coleman et al. This display device generally comprises a plurality of channels for a single line of character display, each channel containing an ionizable medium, particularly an ionizable gas such as neon and nitrogen, and a plurality of pairs of transfer electrodes, the electrodes in each pair being provided on the upper and lower sides of each channel in parallel with each other in a direction perpendicular to the channel. The transfer electrodes are coated with a dielectric film. A write electrode is additionally provided at one end of each channel. By applying potential differences between the oppositely positioned electrodes, the gas is ionized, and light emission occurs. The dielectric film on the electrodes is thus charged and by applying the potential differences in proper sequence, the charges are transferred. The arrangement permits shifting of the displays along the length of the devices and holding of the displays in position when so desired. For displaying a plurality of character lines, the write electrodes are commonly connected. In such arrangement, however, it is inevitable that lead wires run between adjacent character lines and enlarge the area of the display device.

SUMMARY OF THE INVENTION

An object of this invention is to provide a plasma display device having a novel electrode arrangement to eliminate lead wires running within a display area.

The charge transfer plasma display device according to the present invention is featured by input shift electrodes provided between the write electrodes and the transfer electrodes.

The charge transfer plasma display panel according to one aspect of the present invention comprises a first main electrode group whose surface is covered by a dielectric film; a second main electrode group whose surface is covered by a dielectric film; the individual electrodes of the first main electrode group being arranged in such a manner that they are positioned between the individual electrode patterns of the second main electrode group in a plan view, and the first and second main electrode groups sandwiching a gas space, a plurality of groups of information write electrodes located at one end of both the first main electrode group and the second main electrode group in parallel to the electrodes of the first and second main electrode groups, the number of electrodes in the respective groups of the information write electrodes being the same and respective corresponding ones of the information write electrodes in the respective groups being electrically connected in common, and a plurality of input shift electrodes located between the information write electrode groups and the first and second main electrode groups in parallel to the electrodes of the main electrode groups such that the number of the input shift electrodes between the main electrode groups and the different groups of the information write electrodes are different.

DETAILED DESCRIPTION OF THE PREFERRED EMBODIMENTS

Figure 1:
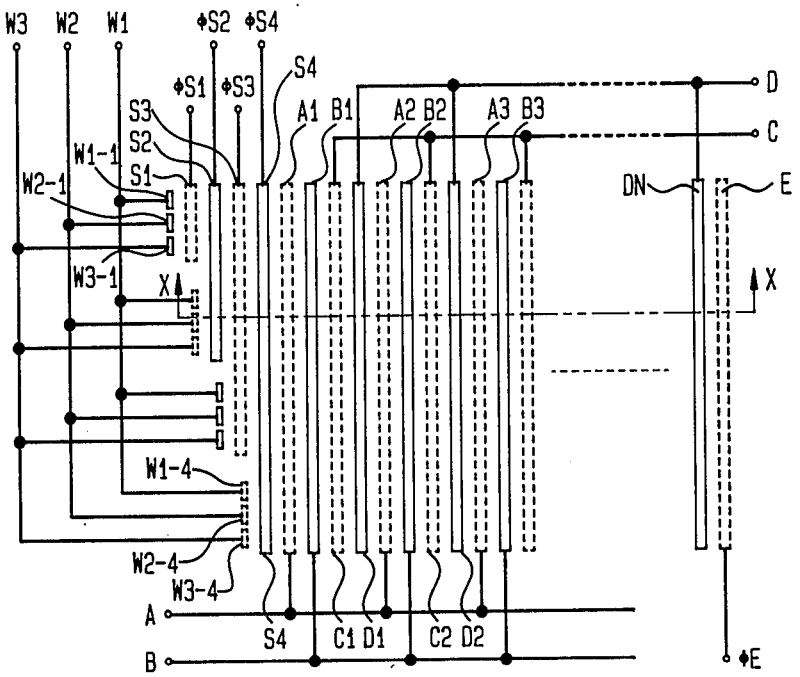
FIG. 1 is a schematic illustration of a charge transfer plasma display device according to a first preferred embodiment of this invention.
Figure 2:
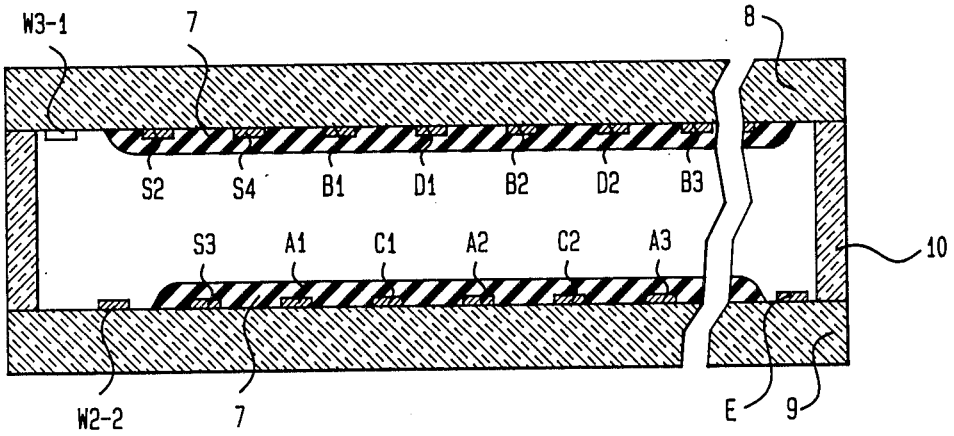
FIG. 2 is a cross-sectional view of the device illustrated in FIG.1 taken along on X—X line of FIG. 1 and looking in the direction of the arrow.

FIG. 1 and FIG. 2 illustrate a structural arrangement according to the first embodiment of this invention. For the sake of clarity, twelve write electrodes, three for each of four groups, are illustrated for twelve channels without showing the other details of the channels. Needless to say, each channel is filled with an ionizable medium such as any one of or a mixture of neon, argon, helium, krypton, xenon, hydrogen and nitrogen gases. The illustrated structure includes three common information write signal terminals W1, W2 and W3. The write terminal W1 is commonly connected to write electrodes W1-1, W1-2, W1-3 and W1-4 which belong to different groups. The write terminal W2 is connected to the write electrodes, in different groups, W2-1, W2-2, W2-3 and W2-4 in common, and the write terminal W3 to W3-1, W3-2, W3-3 and W3-4. A plurality of transfer electrodes are disposed so as to cross all the twelve channels. The upper transfer electrodes B1, D1, B2, D2,. . . illustrated by solid lines are classified into two groups, B and D, with the electrodes in the respective groups B and D being commonly connected to respective transfer signal terminals B and D. The lower transfer electrodes A1, C1, A2, C2, A3, C3,. . . . illustrated by dotted lines are classified into two groups A and C, and the electrodes of the respective groups are connected to the transfer signal terminal A or C in common.

According to the present invention, a plurality of input shift electrodes S1 to S4 are disposed between the write electrodes and the transfer electrode A1 at the end of the array of the transfer electrode groups A, B, C and D.

The upper input shift electrode S4 is arranged between the transfer electrode A1 and the fourth group of the lower write electrodes W1-4, W2-4 and W3-4 and elongated over the length equal to that of the transfer electrode A1. The lower input shift electrode S3 is arranged between the upper input shift electrode S4 and the third group of the upper write electrodes W1-3, W2-3 and W3-3 in the line of the fourth group of the write electrodes over the length of the transfer electrode minus the fourth group of the write electrodes. The upper input shift electrode S2 is arranged between the lower input shift electrode S3 and the second group of the lower write electrodes W1-2, W2-2 and W3-2 in the line of the third group of the write electrodes over the length of the input shift electrode S3 minus the third group of the write electrode. The lower input shift electrode S1 is arranged between the upper input shift electrode S2 and the first group of the upper write electrodes W1-1, W2-1 and W3-1 in the line of the second group of the write electrodes over the length of the first group of the write electrodes.

All the electrodes are positioned in spaced relationship as illustrated in FIG. 1 and FIG. 2, and in addition, alternating electrodes are positioned on opposite sides of the channels. The electrodes illustrated by solid lines are the electrodes formed on the front plate 8, while those indicated by dotted lines are the electrodes formed on the back plate 9. At least the front plate 8 is formed of a transparent material, for example any suitable glass. The plates are held in spaced apart relationship and sealed together at their outside portions 10 so that the ionizable medium is sealed within the structure. A thin insulating coating 7 is disposed over each of the input shift electrodes and the transfer electrodes, and at least the coating on the transfer electrodes on the front plate will be transparent, for example a dielectric glass.

For the reasons more particularly set forth in the aforementioned U.S. Pat. No. 3,781,600, the write electrodes are exposed to the ionizable medium, that is, they are not covered by the insulating material. This enables start-up of the device when a sufficient potential difference is developed between the write electrodes and opposely positioned input shift electrodes. The potential difference results in the creation of a positive charge adjacent the particular input shift electrode as is characteristic of devices of this type. By creating a sufficient potential difference between the next adjacent electrode and the electrode having the positive charge, the ionization position will shift accordingly.

According to the first embodiment of the present invention, first and third groups of the upper write electrodes are disposed on the front plate while the second and fourth groups of the lower write electrodes are disposed on the back plate. The numbers of the input shift electrodes S1 to S4 between different groups of the write electrodes and the transfer electrodes are different. Furthermore, the input shift electrodes have different lengths as that first shift electrode S1 is disposed between the first group of write electrodes and the second shift electrode S2, the second shift electrode S2 between the second group of write electrodes and the third shift electrode S3, the third shift electrode S3 between the third group of write electrodes and the fourth shift electrode S4, and the fourth shift electrodes S4 between the fourth group of write electrodes and the transfer electrode A1. Other features of the illustrated embodiment are that the second group of the write electrodes is located on the extending portion of the first shift electrode S1, the third group of the write electrodes on the extending portion of the second shift electrode S2, and the fourth group of the write electrodes on the extending portion of the third shift electrode S3.

Figure 3:
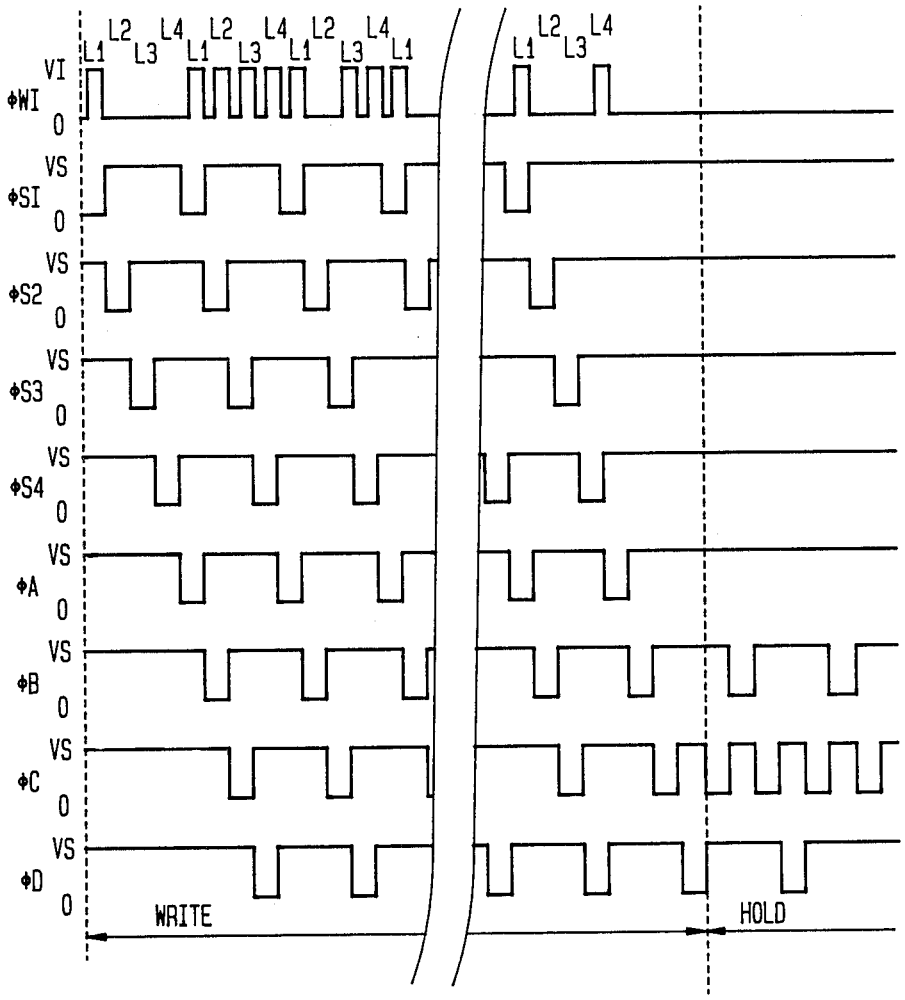
FIG. 3 is a chart illustrating wave forms for explaining the operation of the plasma display device of FIG. 1.

FIG. 3 illustrates the operation of the device shown in FIG. 1. The signal $\phi$W1 in the upper line is applied to the write terminal W1 connected to the write electrodes W1-1, W1-2, W1-3 and W1-4. The signals to be applied to the other write terminals W2 and W3 are omitted from explanation for simplicity. The pulses $\phi$S1, $\phi$S2, $\phi$S3 and $\phi$S4 are the input shift pulses applied to the input shift electrodes S1, S2, S3 and S4, respectively. The other pulses $\phi$A, $\phi$B, $\phi$C and $\phi$D are the drive pulses applied to the transfer terminals A, B, C and D.

The explanation will be made to only those write electrodes connected to the first write terminal W1. As is indicated by the pulse chart of FIG. 3, the write terminal W1 is normally at ground and is pulsed to a positive potential. When it is desired to shift a charge from the write electrode W1-1 to the transfer electrodes, the S1 electrode which is normally at a positive voltage is pulsed by L1 to ground in synchronism with the positive potential at the write terminal W1, thereby creating a sufficient potential difference to ionize the gas between the write electrode W1-1 and the first input shift electrode S1. According to the function of the plasma charge transfer device, this results in a "pip" of light, and leaves a positive charge on the inside wall adjacent the shift electrode S1. The shift electrode S2 is then pulsed to ground by $\phi$S2, resulting in transfer of the charge to the opposite wall adjacent the second shift electrode S2. The shift electrodes S3 and S4 are then pulsed in sequence by $\phi$S3 and $\phi$S4, and thereby the charge is shifted to the fourth electrode S4. The transfer electrode A1 is then pulsed by $\phi$A to ground, resulting in transfer of the charge to the opposite wall adjacent the transfer electrode A1. As indicated in FIG. 3, the B, C and D groups transfer electrodes are then pulsed by $\phi$B, $\phi$C and $\phi$D. This shifts the charge to the transfer electrode D1.

In the foregoing description, a first write operation occurs at channel having the write electrode W1-1. This is because only the shift electrode S1 and write electrode W1-1 are pulsed at the same time, and other write electrodes W1-2, W1-3 and W1-4 are not pulsed when other shift electrodes S2, S3 and S4 are pulsed. When the write terminal W1 is successively pulsed by a train of pulses L1, L2, L3 and L4 which are synchronized with the shift pulses $\phi$S1, $\phi$S2, $\phi$S3 and $\phi$S4, respectively, a second write operation will occur at all channels having the write electrodes W1-1, W1-2, W1-3 and W1-4. In this case, all charges are shifted to the fourth shift electrode S4 when the fourth shift pulse $\phi$S4 is pulsed. Therefore, when the A electrodes are pulsed to ground by $\phi$A, the charges are transferred to the opposite wall adjacent the transfer electrode A1, while the charge produced by the first write operation is shifted to the transfer electrode A2. The write operation is executed successively in the same manner.

With respect to the remaining write electrodes connected to the write terminals W2 and W3, the same operation described above is done. During the write operation, as is apparent from the foregoing explanation and is shown in FIG. 3, the shift electrodes and the transfer electrodes are pulsed successively and the write electrodes are pulsed selectively. Instead, the write electrodes and the transfer electrodes may be pulsed in a predetermined and successive manner and the shift electrodes may be selectively pulsed. After the write operation, as shown in FIG. 3, a "hold" operation then occurs. The hold operation is achieved by pulsing in the sequence CBC, DCB, in the same manner as the prior art charge transfer device. Thus the charge is sequentially moved back and forth between the D and B electrodes. The hold operation is not restricted to the illustrated one. That is, it can be achieved by pulsing in the sequence CBA, BCD, CBA. Since "pips" will result in the case of each hold pulse, the result will be the appearance of a segment of light having a length corresponding to the distance between the D and A electrodes.

When it is desired that a charge or charges be removed from the device, the charge is moved adjacent an erase electrode E, and the electrode E is pulsed to ground without a succeeding pulse being provided to shift the charge away from the erase electrode E. In that event, the charge is conducted away through an erase lead. For example, such pulses applied to the transfer electrode A during the write operation can be used as the erase pulses.

As is apparent from the foregoing, both of the hold operation and the erase operation are similar to those in the prior art.

According to the first embodiment of the present invention, the number of drive circuits is reduced by arranging input shift electrodes between the transfer electrodes and write electrodes. Furthermore, by disposing the write electrodes on both of the front and back plates, the structure of the devices becomes simple. Lead wires do not run within the display area, and the display device can be simply manufactured using conventional technology.

As already explained, the entire display picture of the charge transfer plasma display device of the first embodiment of the present invention comprises only four transfer signal terminals and thereby offers the advantage of substantially reducing the number of drive circuits. However, it is difficult to manufacture large display devices with uniform voltage over the entire screen. This presents the problem of a low yield of the devices. The charge transfer plasma display device in the second preferred embodiment of the present invention solves this problem by dividing the transfer electrode group into a plurality of blocks in the direction of the arrangement of the transfer electrode group and by providing each block with the four transfer signal terminals.

Figure 4:
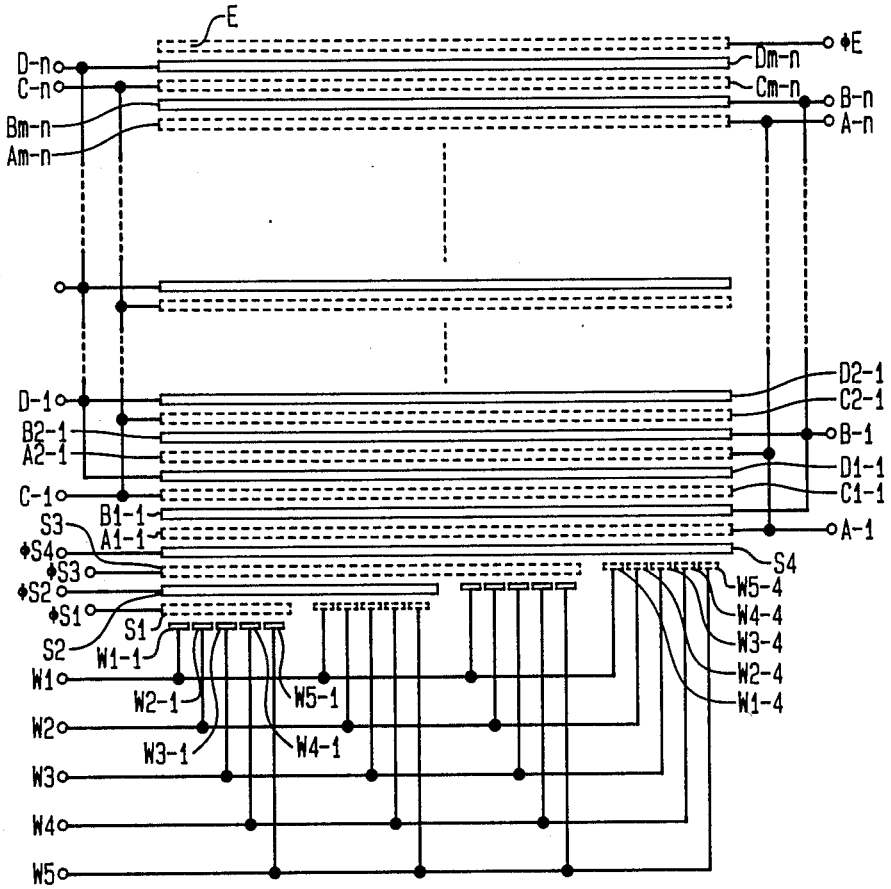
FIG. 4 shows a second embodiment of the invention.

Referring to FIG. 4, the second preferred embodiment of the present invention comprises four groups of write electrodes, each group having five write electrodes. The first group of write electrodes are designated as W1-1, W2-1, W3-1, W4-1 and W51, the second group as W1-2, W2-2, W3-2, W4-2 and W5-2, the third group as W1-3, W2-3, W3-3, W4-3 and W5-3, the fourth group as W14, W2-4, W3-4, W4-4 and W5-4. The write terminal W1 is commonly connected to the write electrodes W1-1, W1-2, W1-3 and W1-4, the write terminal W2 to the write electrodes W2-1, W2-2, W2-3 and W2-4, the write terminal W3 to the write electrodes W3-1, W3-2, W3-3 and W3-4, the write terminal W4 to the write terminal W4-1, W4-2, W4-3 and W4-4, and the write terminal W5 to the write electrodes W5-1, W5-2, W5-3 and W5-4.

Four input shift electrodes S1, S2, S3 and S4 are arranged between the transfer electrode A1 and the first group of the write electrodes W1-1, W2-1, W3-1, W4-1 and W5-1. Since the relationship of the input shift electrodes, write electrodes and the transfer electrode A1 resembles that illustrated in FIG. 1, a detailed description thereof is omitted.

As in FIG. 1, the electrodes represented by solid lines in FIG. 4 are those which are formed on the front plate, while those indicated by dotted lines are electrodes formed on the back plate. A major difference from the first preferred embodiment lies in the fact that the transfer electrodes A to D are divided into m (pieces)×n (blocks) in the direction of the charge transfer and the four transfer electrode terminals for the transfer electrodes A to D are provided for each block. The operation in the second preferred embodiment is similar to that in the first preferred embodiment shown in FIG. 1. The characteristics of the device according to the second preferred embodiment are that pulse waveforms of different voltages for individual blocks can be applied to the transfer electrode groups and that voltage dispersions inside the panel can be absorbed to some extent, by suitably selecting the drive voltage for each block. This produces a charge transfer plasma display device with suitable driving.

Figure 5:
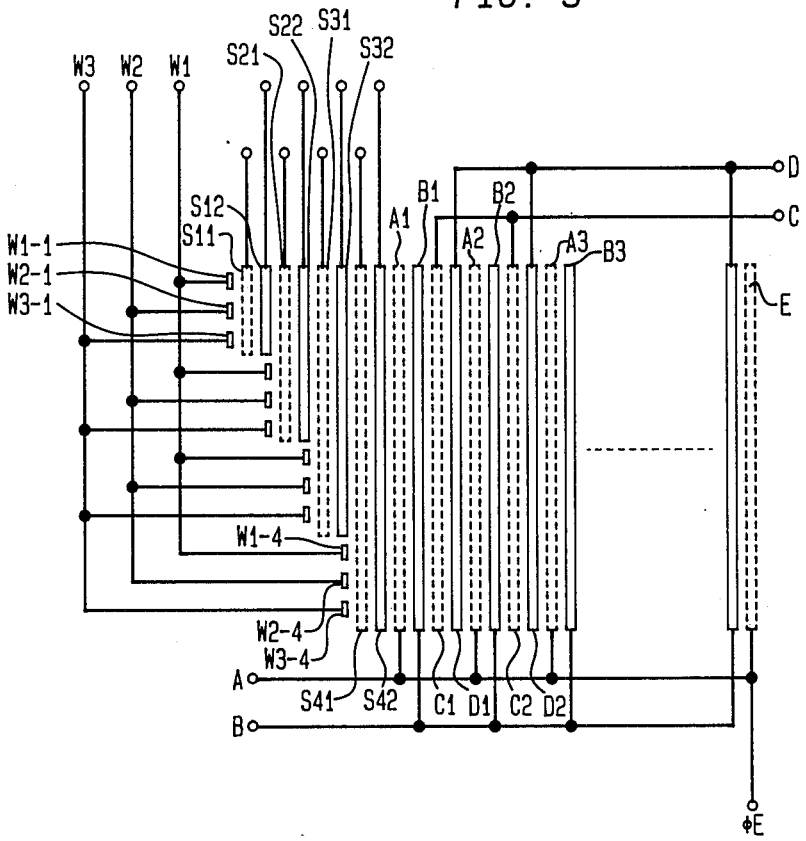
FIG. 5 shows a third embodiment of the invention.

Referring FIG. 5, a third preferred embodiment of the present invention is featured in that all the write electrodes are provided on the front plate. In this case, however, additional input shift electrodes are needed to shift the charge to the transfer electrode A1. When twelve write electrodes are divided into four groups just as in the case of FIG. 1, eight input shift electodes S11, S12, S21, S22, S31, S32, S41, S42 are arranged between the transfer electrode A1 and first write electrodes W1-1, W2-1 and W3-1. The upper input shift electrode S42 is arranged between the transfer electrode A1 and the fourth group of the upper write electrodes W1-4, W2-4, and W3-4 and elongated over the length equal to that of the transfer electrode A1. The lower input shift electrode S41 is arranged between the upper input shift electrode S42 and the upper write electrodes W1-4, W2-4 and W3-4 and has the same length of that of the shift electrode S42. The upper input shift electrode S32 is arranged between the lower input shift electrode S41 and the third group of the upper write electrodes W1-3, W2-3 and W3-3 in the line of the fourth group of the write electrodes over the length of the transfer electrode minus the fourth group of the write electrodes. The lower input shift electrode S31 is arranged between the upper shift electrode S32 and the upper third group of the write electrodes and has the same length of that of the shift electrode S32. The upper input shift electrode S22 is arranged between the lower input shift electrode S31 and the second group of the upper write electrodes W1-2, W2-2, and W3-2 in the line of the third group of the write electrodes over the length of the shift electrode S31 minus the third group of the write electrodes. The lower input shift electrode S21 is arranged between the upper shift electrode S22 and the upper second group of the write electrodes and has the same length of that of the shift electrode S22. The upper input shift electrode S12 is arranged between the lower input shift electrode S21 and the first group of the upper write electrodes W1-1, W2-1 and W3-1 in the line of the second group of the write electrodes over the length of the shift electrode S21 minus the second group of the write electrodes. The lower input shift electrode S11 is arranged between the upper shift electrode S12 and the first group of write electrodes and has the same length of that of the shift electrode S12.

Needless to say, the electrodes illustrated by solid lines are the upper electrodes formed on the front plate, while those indicated by dotted lines are the lower electrodes formed on the back plate. Since the arrangement of the transfer electrodes A, B, C and D, and an erase electrode E has the same arrangement as indicated in FIG. 1, the related explanation is omitted here.

Figure 6:
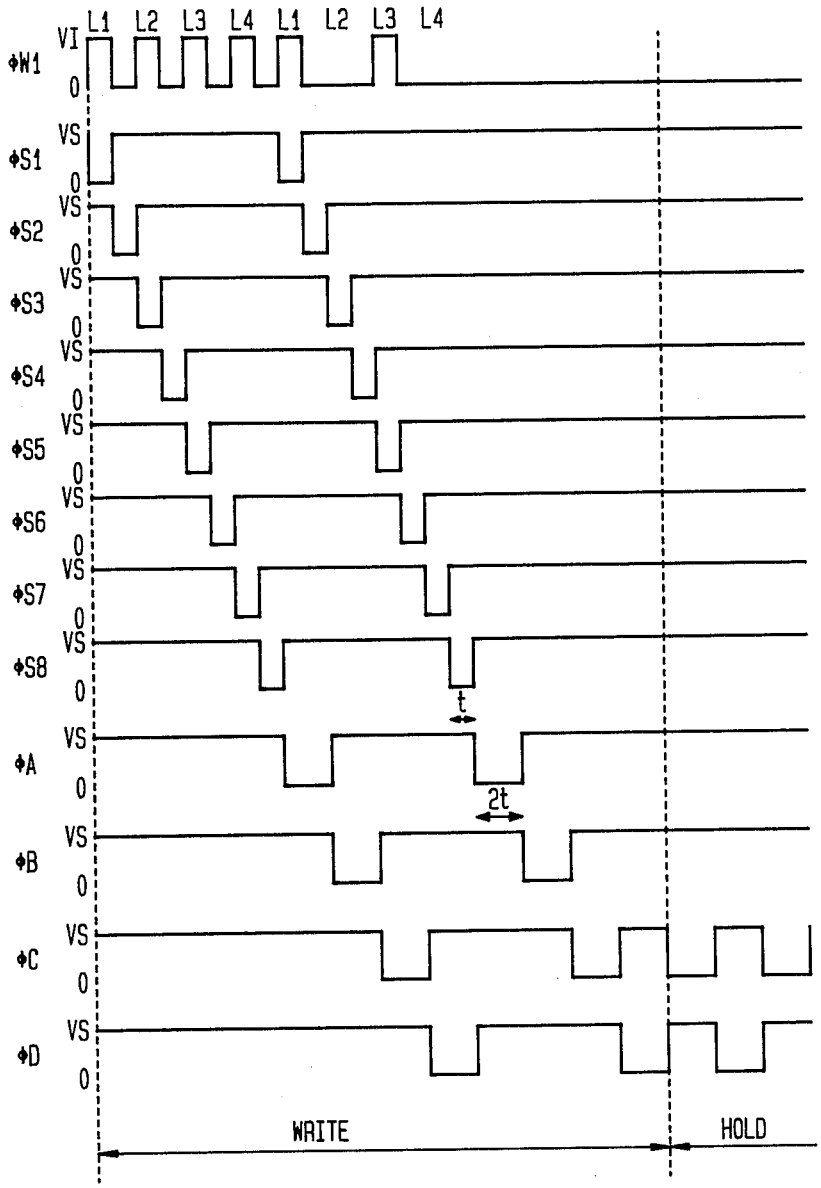
FIG. 6 shows wave forms illustrating the operation of the plasma display device of FIG. 5.

FIG. 6 illustrates the operation of the device shown in FIG. 5. The signal $\phi$W1 in the upper line is applied to the write terminal W1 connected to the write electrodes W1-1, W1-2, W1-3, and W1-4. The pulses $\phi$S1, $\phi$S2, $\phi$S3, $\phi$S4, $\phi$S5, $\phi$S6, $\phi$S7, $\phi$S8 $\phi$S21, $\phi$S22, $\phi$S31, $\phi$S32, $\phi$S41 and are the eight phase input shift pulses applied to the input shift electrodes S11, S12, S21, S22, S31, S32, S41 and S42, respectively. The other pulses $\phi$A, $\phi$B, $\phi$C, and $\phi$D are the four phase transfer pulses applied to the transfer terminals A, B, C and D. In this case, the pulse width of the four phase drive pulses $\phi$A to $\phi$D should be twice of the pulse width t of the eight phase input shift pulses $\phi S1$ to $\phi S8$. Since other needed operations resemble those described in the first embodiment, their explanation is omitted here.

As is apparent from the foregoing embodiments according to the present invention, the number of drive circuits is reduced and lead wires do not run within display area, and the display device can be simply manufactured using conventional technology.

I claim:

1. A charge transfer plasma display device comprising:

an enclosure having a plurality of parallel channels containing an ionizable medium, each of said channels being defined within a walled structure, at least one wall thereof being transparent;

a plurality of write electrodes provided on at least one inside wall surface, said write electrodes being arranged in a plurality of groups;

means for electrically connecting each one of said write electrodes belonging to each group to an associated write electrode in each of the other groups of write electrodes;

a plurality of transfer electrodes arranged in alternating sequence and offset from one another on opposite inside wall surfaces;

a plurality of input shift electrodes arranged in alternating sequence and offset from one another on opposite inside wall surfaces, said input shift electrodes being located between said write electrodes and said transfer electrodes such that the number of said input shift electrodes present in plan view between each one group of said write electrodes and said transfer electrodes is different from the number of said input shift electrodes present in plan view between every other group of said write electrodes and said transfer electrodes;

means for applying pulses in a predetermined successive manner to said transfer electrodes;

means for applying pulses selectively to one of said input shift electrodes and said write electrodes; and means for applying pulses in a predetermined successive manner to the other of said input shift electrodes and said write electrodes.

2. A charge transfer plasma display device comprising:

an enclosure having a plurality of parallel channels containing an ionizable medium, each of said channels being defined within a walled structure, at least one wall thereof being transparent;

a plurality of transfer electrodes arranged on opposite side walls of said enclosure;

a first and second input shift electrodes arranged adjacently to said transfer electrodes in parallel to each other and to said transfer electrodes;

a first write electrode and a second write electrode arranged in plan view adjacent said first input shift electrode and separated in plan view from said transfer electrodes; and a third and a fourth write electrodes arranged in plan view adjacent said second input shift electrode and separated in plan view from said transfer electrodes by said second input shift electrode, said first and third electrodes being electrically connected in common, and said second and fourth electrodes being electrically connected in common.

3. The display device of claim 1 wherein said input shift electrodes each have a different length and are arranged in order of increasing length.

4. The display device of claim 3 wherein at least one of said groups of write electrodes is in line with one of said input shift electrodes.

5. The display device of claim 4 wherein the combined length of said one group of write electrodes and said one input shift electrode is approximately the same as the length of the next adjacent shift electrode.

6. The display device of claim 1 wherein said transfer electrodes are arranged in plural blocks each containing a predetermined number of electrodes, and further including means for applying different voltages to the electrodes of different blocks, respectively.

7. The display device of claim 1 wherein all of said write electrodes are provided on the same surface of said enclosure, and further wherein said shift electrodes are arranged in two groups with all of the shift electrodes in one group being on said same surface and all of the electrodes of the other group being on the opposite surface and with each group of shift electrodes having a number of electrodes equal to the number of groups of write electrodes.

8. The display device of claim 2 wherein said third and fourth write electrodes are arranged in the same rank of said first input shift electrode.

* * * * *